United States Patent [19]

Kajiyama

[11] Patent Number: 4,547,998

[45] Date of Patent: Oct. 22, 1985

[54] ELECTRODEPOSITED GRINDING TOOL

[75] Inventor: Keiichi Kajiyama, Tokyo, Japan

[73] Assignee: Disco Abrasive Systems, Ltd., Tokyo, Japan

[21] Appl. No.: 566,374

[22] Filed: Dec. 28, 1983

[30] Foreign Application Priority Data

Oct. 7, 1983 [JP] Japan ..... 58-187009

[51] Int. Cl.[4] ..... B24D 7/22

[52] U.S. Cl. ..... 51/206 R; 51/296; 125/15

[58] Field of Search ..... 51/206 R, 296; 125/15

[56] References Cited

U.S. PATENT DOCUMENTS

| | | | |
|---|---|---|---|
| 2,073,678 | 3/1937 | Broughton | 125/15 |
| 2,730,439 | 1/1956 | Houchins | 51/206 R |
| 2,806,772 | 9/1957 | Robie | 51/296 |
| 3,640,027 | 2/1972 | Weiss | 51/206 R |
| 3,847,568 | 11/1974 | Cihon | 51/296 |
| 4,086,067 | 4/1978 | Busch | 51/296 |

*Primary Examiner*—Harold D. Whitehead

*Attorney, Agent, or Firm*—Beveridge, DeGrandi & Weilacher

[57] ABSTRACT

An electrodeposited grinding tool having an electrodeposited abrasive layer formed by electrodepositing abrasive grains to an electrodeposition thickness at least three times as large as the diameter of the abrasive grains. Pores are dispersed in the electrodeposited abrasive layer in a volume ratio of 10 to 70%.

24 Claims, 9 Drawing Figures

GROUND SURFACE ROUGHNESS (μm)
0.5
0.4
0.3
0.2
0.1
0
COMPARATIVE EX. A-1
EX. A-1
EX. A-2
EX. A-3
EX. A-4
EX. A-5
EX. A-6
EX. A-7
10
20
30
40
50
60
70
VOLUME RATIO OF PORES (%)

FRACTURE LOAD (Kgf/mm²)
4
3
2
1
0
COMPARATIVE EX. 1
EX. A-1
EX. A-2
EX. A-3
EX. A-4
EX. A-5
EX. A-6
EX. A-7
10
20
30
40
50
60
70
VOLUME RATIO OF PORES (%)

ELECTRODEPOSITED GRINDING TOOL

FIELD OF THE INVENTION

This invention relates to electrodeposited grinding tool, and more specifically, to an electrodeposited grinding tool an abrasive layer formed by electrodepositing abrasive grains, particularly superabrasive grains, to a thickness at least three times as large as the diameter of the grains.

DESCRIPTION OF THE PRIOR ART

Electrodeposited grinding tools having an abrasive layer formed by electrodepositing abrasive grains, particularly superabrasive grains such as natural or synthetic diamond abrasive grains or cubic boron nitride abrasive grains, have heretofore been proposed and found practical applications for grinding or cutting hard to hard and brittle materials. Ordinary electrodeposited grinding tools are generally obtained by electrodepositing only one layer of abrasive grains on a supporting member, and $\frac{1}{3}$ to $\frac{1}{2}$ of the individual abrasive grains project from a bonding agent, i.e. a deposited metal. Electrodeposited grinding tools of such a form, however, have the defect that the presence of only one abrasive layer naturally makes their service life short. Hence, in recent years, electrodeposited grinding tools having an abrasive layer formed by electrodepositing abrasive grains to a considerable thickness, for example to a thickness several to several tens of times as large as the diameter of the abrasive grains have also been proposed and come into commercial acceptance.

The present inventor has conducted extensive experiments and investigations about grinding and cutting by the conventional electrodeposited grinding tools having an abrasive layer electrodeposited to a considerable thickness. These works have led to the discovery that the electrodeposited grinding tools having an electrodeposited abrasive layer of a considerable thickness are not entirely satisfactory in regard to the accuracy of grinding or cutting and the efficiency of grinding or cutting, and have still to be improved in these respects.

SUMMARY OF THE INVENTION

It is a primary object of this invention therefore to provide an electroposited grinding tool having an abrasive layer formed by electrodepositing abrasive grains to a considerable thickness, which has an improved accuracy of grinding or cutting and an improved efficiency of grinding or cutting over the conventional electrodeposited grinding tools.

The present inventor further conducted experiments and investigations about the structure of, and the grinding or cutting by, an electrodeposited grinding tool having an abrasive layer formed by electrodepositing abrasive grains to a considerable thickness, and has now found the following surprising fact. In the past, it has been recognized that in a grinding tool having an abrasive layer formed by electrodepositing superabrasives to a considerable thickness for grinding or cutting hard to hard and brittle materials, the abrasive grains should desirably be held as firmly as possible because a fairly large force is exerted on the abrasive grains during grinding or cutting. Based on this recognition, it has been considered as desirable to file the spaces between the electrodeposited abrasive grains as much as possible with a deposited metal, thereby minimizing pores in the electrodeposited abrasive layer and thus maximizing the degree of bonding of the abrasive grains. It has now been found by the present inventor that contrary to the above conventional thought, the accuracy of grinding or cutting and the efficiency of grinding or cutting with such an electrodeposited grinding tool can be markedly increased by dispersing pores in a specified volume ratio in the electrodeposited abrasive layer.

On the basis of the aforesaid fact discovered by the present inventor, the present invention provides an electrodeposited grinding tool having an abrasive layer formed by electrodepositing abrasive grains to an electrodeposition thickness at least three times as large as the diameter of the abrasive grains, said abrasive layer having pores dispersed therein in a volume ratio of 10 to 70%.

In a preferred embodiment of the electrodeposited grinding tool of this invention, the volume ratio of the pores is 20 to 60%. To adjust the volume ratio of the pores easily to the required range, at least a part of abrasive grains to be electrodeposited are coated with a metal film prior to electrodeposition.

BRIEF DESCRIPTION THE DRAWINGS

FIG. 1 is a sectional view showing one embodiment of the electrodeposited grinding tool constructed in accordance with this invention;

FIG. 2 a microphotograph of the surface of the electrodeposited abrasive grain layer of a conventional electrodeposited grinding tool;

DETAILED DESCRIPTION OF PREFERRED EMBODIMENTS

Figure 1:
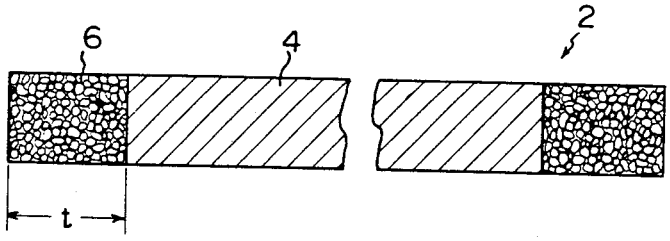

With reference to FIG. 1 showing a typical example of the electrodeposited grinding tool constructed in accordance with this invention, the illustrated electrodeposited grinding tool shown generally at 2 is generally composed of a supporting member 4 and an electrodeposited abrasive layer 6.

In the illustrated embodiment, the supporting member 4 of a disc shape may be formed from a suitable material such as steel, brass, aluminum or copper.

The electrodeposited abrasive layer 6 in the illustrated embodiment is formed in an annular shape by electrodepositing abrasive grains on the peripheral surface of the disc-shaped supporting member 4. It is essential that the electrodeposition thickness t of the electrodeposited abrasive layer 6 should be at least three times the diameter of the abrasive grains. If the thickness t is less than three times the diameter of the abrasive grains, the abrasive grains are present only in one or two layers in the electrodeposited abrasive layer 6. Hence, the service life of the electrodeposited grinding tool 2 becomes very short, and it is very difficult, if not impossible, to satisfy the requirement about pores which is most important in the electrodeposited grinding tool 2 constructed in accordance with this invention.

The size of abrasive grains is generally defined by their particle size expressed in U.S. mesh numbers. The term "diameter of abrasive grains" used in the present application denotes the length of one side of a square opening of a mesh used in defining the particle diameter. For example, when the particle size of abrasive grains is U.S. mesh No. 320, the "particle diameter of abrasive grains" is 44 μm which is the length of one side of a square opening of U.S. 320 mesh. For grinding or cutting hard to hard and brittle materials such as semiconductor wafers, lenses or ferrite or metallic materials such as Sendust, superhard alloys and steel, the abrasive grains to be electrodeposited are preferably natural or synthetic diamond abrasive grains or cubic boron nitride abrasive grains. The particle diameter of the abrasive grains can be properly selected according to the purpose of using the electrodeposited grinding tool 2.

It is essential that in the electrodeposited grinding tool constructed in accordance with this invention, pores should be dispersed in a volume ratio of 10 to 70%, preferably 20 to 60%, in the electrodeposited abrasive layer 6. Desirably, the pores are fully uniformly dispersed throughout the entire electrodeposited abrasive layer 6. They may be a number of small closed pores or large pores open over a wide range. Or the two types of pores may be present together. As will be made clear from the following description, when the volume ratio of pores in the electrodeposited abrasive layer 6 is less than 10%, a sufficient grinding or cutting accuracy cannot be obtained, and a sufficient efficiency of grinding or cutting can neither be obtained. On the other hand, when the volume ratio of the pores in the electrodeposited abrasive layer 6 exceeds 70%, the strength of the electrodeposited abrasive layer 6 becomes impermissibly low and excessive abrasive grains drop off from the electrodeposited abrasive layer 6. As a result, the efficiency of grinding or cutting is reduced and the service life of the electrodeposited grinding tool 2 becomes unduly short. When the volume ratio of the pores in the electrodeposited abrasive layer 6 is from 10 to 70%, preferably from 20 to 60%, a sufficient grinding or cutting accuracy and a sufficient efficiency of grinding or cutting can be obtained. The present inventor has assigned the following reason for this characteristic feature of the invention. In conventional electrodeposited grinding tool, the volume ratio of pores in the electrodeposited abrasive layer is substantially zero, or extremely low, and the interstices among the abrasive grains are filled with a bonding agent, i.e. a deposited metal. In this structure, the power of holding the abrasive grains by the deposited metal is excessively strong, and scarcely any abrasive grains drops off from the electrodeposited abrasive layer at the time of grinding or cutting. Accordingly, the abrasive grains scarcely develop their self-sharpening action, and grinding or cutting is carried out by worn abrasive grains. This is presumably the cause of the insufficient grinding or cutting accuracy of the conventional electrodeposited grinding tools. In contrast, when pores are dispersed in the electrodeposited abrasive layer 6 in a volume ratio of 10 to 70%, preferably 20 to 60%, the power of holding the abrasive grains by the deposited metal is suitably weakened, and the abrasive grains drop off properly from the electrodeposited abrasive layer 6 at the time of grinding or cutting to develop their suitable self-sharpening action. This presumably leads to the sufficient grinding or cutting accuracy and the sufficient efficiency of grinding or cutting of the grinding tool of the invention. In addition, when the pores are dispersed in a volume ratio of 10 to 70%, preferably 20 to 60%, in the electrodeposited abrasive layer, grinding or cutting chips can be easily discharged owing to the presence of the pores dispersed therein. Furthermore, the presence of the pores increases the efficiency of heat dissipation and permits good flowing of cooling water and therefore provides a high cooling effect. This is presumably another reason why the grinding tool of the invention has an increased accuracy of grinding or cutting and an increased efficiency of grinding or cutting. When the volume ratio of the pores in the electrodeposited abrasive layer 6 exceeds 70%, the power of holding the abrasive grains by the deposited metal is excessively reduced, and the abrasive grains drop excessively from the electrodeposited abrasive layer 6. Consequently, the efficiency of grinding or cutting is reduced and the strength of the electrodeposited abrasive layer 6 itself becomes impermissibly low to shorten excessively the service life of the electrodeposited grinding tool 2.

Figure 2:
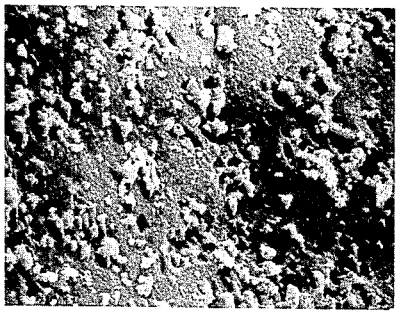

In the production of a conventional electrodeposited grinding tool, abrasive grains are directly kept suspended in an electrolytic solution with stirring and electrodeposited on a supporting member. The abrasive grains accumulated on the supporting member are electrodeposited as a result of their being embedded in the deposited metal. Hence, the interstices among the abrasive grains are usually filled with the deposited metal, and substantially no pores exsist in the electrodeposited abrasive layer. Or a very few pores do even if they do. FIG. 1 shows a microphotograph (1500 magnifications) of the surface of an electrodeposited abrasive layer which was formed by keeping synthetic diamond abrasive grains of U.S. mesh No. 4000 suspended with stirring in an electrolytic solution containing a nickel ion and electrodepositing them on a supporting member by an electrodeposition method well known per se. It is seen from FIG. 2 that substantially no pore exists in the electrodeposited abrasive layer.

Figure 3:
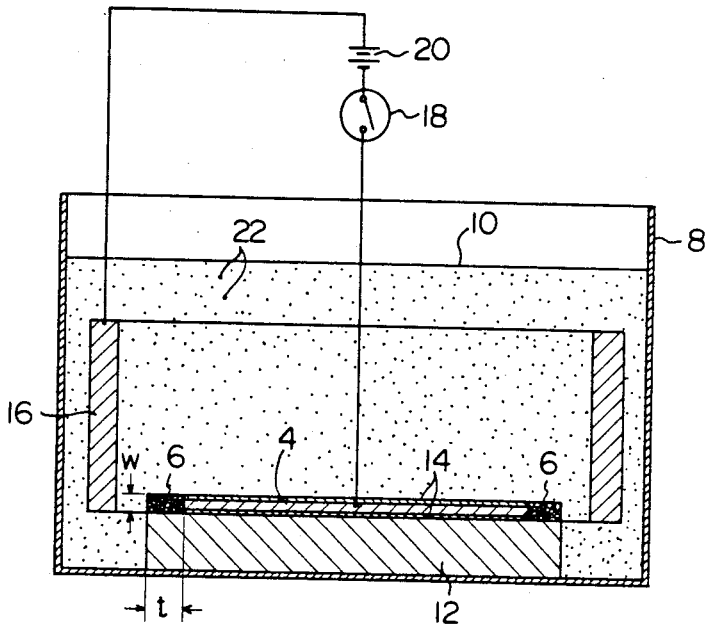
FIG. 3 is a simplified sectional view diagrammatically showing one example of an electrodeposition step for production of the electrodeposited grinding tool of the invention.

Dispersing of the desired pores in the electrodeposited abrasive layer 6 can be achieved, for example, by forming the electrodeposited abrasive layer 6 in the following manner. Prior to the electrodepositing step, the individual abrasive grains are coated with a suitable metal film such as nickel, copper or titanium. Coating of the abrasive grains can be performed, for example, by an electroless plating method comprising mixing abrasive grains with an electroless plating solution containing a metal ion, and shaking the electroless plating solution at a predetermined temperature, thereby plating the metal film on the abrasive grains. Alternatively, the metal film coating of the abrasive grains can be effected by a vapor deposition method, a sputtering method or a chemical vapor deposition method known per se. The abrasive grains thus coated with the metal film are suspended in an electrolytic solution with stirring and electrodeposited. One example of the electrodeposition step is briefly described with reference to FIG. 3. In an electrodeposition apparatus shown diagrammatically in FIG. 3, a known electrolytic solution 10 containing a nickel ion is put in an electrolytic cell 8. A disc-like base stand 12 made of an insulating material is disposed in the electrolytic solution 10, and a disc-shaped supporting member 4 whose two side surfaces are covered with an insulating material 14 and whose peripheral surface is exposed to view is concentrically placed on the base stand 12. The outside diameter of the base stand 12 is larger by a predetermined magnitude than the outside diameter of the supporting member 4. The upper peripheral edge portion of the base stand 12 is exposed to view without being covered by the supporting member. A cylindrical nickel anode 16 is immersed in the electrolytic solution 10. A switch 18 and a DC power supply 20 are connected between, and to, the anode 16 and the supporting member 4. In this electrodeposition apparatus, abrasive grains 22 coated with the metal film in the manner stated above are put in the electrolytic solution 10. Then, the electrolytic solution 10 is stirred by a suitable stirring mechanism (not shown) to suspend the abrasive grains 22. Then, the switch 18 is closed to apply a DC voltage across the anode 16 and the supporting member 4. As a result, nickel begins to deposit on the peripheral surface of the supporting member 4 because the two side surfaces of the supporting member 4 are covered with the insulating material 14 and only its peripheral surface is exposed. In the meantime, the abrasive grains 22 suspended in the electrolytic solution gradually descend and fall onto the upper peripheral edge portion of the base stand 12. When the abrasive grains 22 contact nickel deposited on the peripheral surface of the supporting member 4, they are bonded by the deposited nickel. Since the abrasive grains 22 have the metal film coating, nickel also begins to deposit on the metal film coatings on the abrasive grains. Accordingly, when other abrasive grains 22 which have fallen contact the already bonded abrasive grains 22, the other abrasive grains 22 are bonded to the already bonded abrasive grains 22 by the deposited nickel. In this manner, the abrasive grains 22 are successively bonded onto the peripheral surface of the supporting member 4 to form an electrodeposited abrasive grain layer 6. In the resulting electrodeposited abrasive layer 6, spaces are left among the abrasive grains 22 because nickel deposits on the metal film coating of the already bonded abrasive grains 22 and by the deposited nickel, other abrasive grains 22 are bonded to the already bonded abrasive grains 22. Accordingly, pores are fully uniformly dispersed in the electrodeposited abrasive layer 6. The volume ratio of the pores in the electrodeposited abrasive layer 6 can be properly adjusted by changing the density of the abrasive grains 22 to be included in the electrolytic solution 10, the degree of stirring of the electrolytic solution 10, the DC value (therefore, the speed of nickel deposition), etc. Furthermore, after forming the electrodeposited abrasive layer 6, the volume ratio of the pores in the electrodeposited abrasive layer 6 may be decreased sufficiently uniformly to the required value by performing electrodeposition again while passing an electrolytic solution not containing the abrasive grains 22 through the electrodeposited abrasive layer 6, or passing an electroless plating solution containing a nickel ion through the electrodeposited abrasive layer 6, thereby to deposit nickel in the spaces in the electrodeposited abrasive layer 6. After the electrodeposited abrasive layer 6 has been formed in this manner to a required thickness t and a required width w, the electrodeposited grinding tool 2 is taken out. Then, the insulating material is peeled off from the two side surfaces of the supporting material 4, and the outside surface of the electrodeposited abrasive layer 6 is polished to a required shape by a suitable method. Thus, the electrodeposited grinding tool 2 is finished.

In the aforesaid electrodeposited step, the metal film is coated on all of the abrasive grains 22 to be included into the electrolytic solution. Pores can also be dispersed in the electrodeposited abrasive layer even if the electrodeposition is effected by using abrasive grains having a metal film coating and abrasive grains not coated with a metal film are used together in the electrolytic solution. In this case, the volume ratio of the pores in the electrodeposited abrasive layer can be adjusted also by changing the ratio between the amount of the metal-coated abrasive grains and that of the uncoated abrasive grains to be included in the electrolytic solution. Furthermore, the pores can be dispersed in the electrodeposited abrasive layer even when the electrodeposition coating is effected by including a mixture of abrasive grains coated or non-coated with a metal film and suitable metal particles such as nickel, copper or titanium particles. In this case, the volume ratio of the pores in the electrodeposited abrasive layer can be adjusted also by changing the ratio between the amount of the abrasive grains and that of the metal particles to be included in the electrolytic solution.

Figure 4:
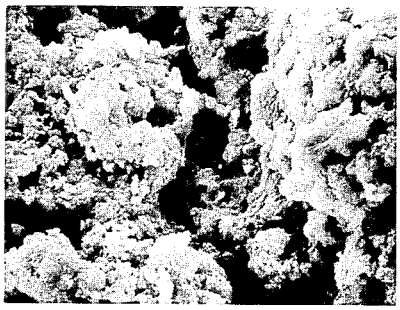
FIG. 4 is a microphotograph of the surface of an electrodeposited abrasive layer in one embodiment of the electrodeposited grinding tool constructed in accordance with this invention.

FIG. 4 is a microphotograph (1500 magnifications) of the surface of an electrodeposited abrasive layer which was formed by coating synthetic diamond abrasive grains of U.S. mesh No. 4000 by an electroless plating method and then subjecting them to the same electrodeposition step as described above with reference to FIG. 3. It will be easily understood from FIG. 4 that pores are fully uniformly dispersed in the electrodeposited abrasive layer. A comparison of FIG. 2 with FIG. 4 will immediately show a marked difference in structure between the pore-free electrodeposited layer in a conventional electrodeposited grinding tool and the electrodeposited abrasive layer containing pores dispersed therein in the electrodeposited grinding tool of this invention. The volume ratio of the pores in the electrodeposited abrasive layer shown in FIG. 4 was 50%. The volume ratio of such pores was determined by (1) cutting a part of the electrodeposited abrasive layer to prepare a sample and sealing the pores of the sample with paraffin to hamper incoming of water into the pores, (2) immersing the sample in water and measuring the total volume of the sample, (3) heating the sample to melt and remove the paraffin and measuring the weight of the sample, (4) dissolving and removing nickel in the sample by using nitric acid and measuring the weight of the synthetic diamond abrasive grains in the sample, (5) calculating the volume of nickel and the volume of the synthetic diamond abrasive grains in the sample from the weight of the sample and the weight of the synthetic diamond abrasive grains measured in (3) and (4) above, and then (6) calculating the volume of the pores from the total volume of the sample, the volume of nickel and the volume of the synthetic diamond abrasive grains.

In the above description, the electrodeposited grinding tool of this invention has been described with reference to the electrodeposited grinding tool 2 of a specified shape. But the shapes of the supporting member and the electrodeposited abrasive layer of the electrodeposited grinding tool of this invention can be varied according to the purpose of use. An electrodeposited grinding tool composed only of an electrodeposited abrasive layer can also be formed by melting and removing the supporting member after the formation of the electrodeposited abrasive layer, without departing from the scope of the invention.

The following Examples and Comparative Examples illustrate the present invention more specifically.

Examples A-1 to A-7

Figure 5:
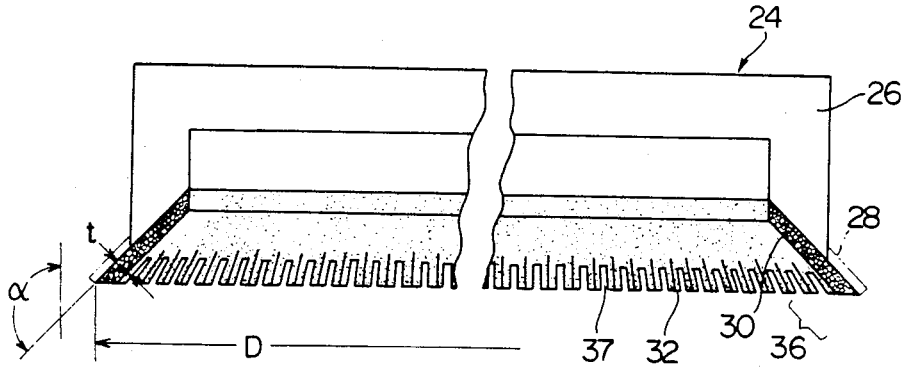
FIG. 5 is a sectional view showing the form of the electrodeposited grinding tool used in Examples A-1 to A-7 and Comparative Example A-1.

A nearly cup-shaped aluminum supporting member 24 having the shape shown in FIG. 5, more specifically having a portion 26 shown by a solid line and a portion 28 shown by a two-dot chain line was produced. Synthetic diamond abrasive grains having U.S. mesh No. 4000 were coated with nickel by an electroless plating method. Then, the surface of the supporting member 24 excepting the inclined lower surface 30 was covered with an insulating material. The supporting member 24 was then immersed upside down in an electrolytic solution containing a nickel ion. At the same time, a nickel plate as an anode was immersed in the electrolytic solution. The nickel-coated synthetic diamond abrasive grains were suspended with stirring in the electrolytic solution, and electrodeposition was started. As a result, an electrodeposited abrasive layer 32 was formed on the inclined lower surface 30 of the supporting member 24. The supporting member 24 and the electrodeposited abrasive layer 32 formed on its inclined lower surface 30 was taken out from the electrolytic solution, and the insulating layer was peeled off only from the surface of the portion 28 indicated by the two-dot chain line of the supporting member 24. The supporting member 24 and the electrodeposited abrasive grain layer 32 were immersed in an aqueous solution of sodium hydroxide to dissolve and remove the portion 28 of the supporting member 24. Then, circumferentially spaced cuts 37 were formed on the free end portion 36 of the electrodeposited abrasive layer 32 which had been supported by the removed portion of the supporting member 24.

By the foregoing procedure, electrodeposited grinding tools of Examples A-1 to A-7 in accordance with this invention were produced which had the shape shown in FIG. 5 and a pore volume ratio, in the electrodeposited abrasive layer 32, of about 10%, about 20%, about 30%, about 40%, about 50%, about 60% and about 70%, respectively.

Figure 6:
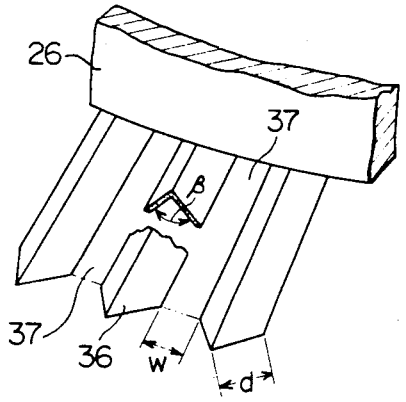
FIG. 6 is a partial perspective view showing the shape of the free end portion of the electrodeposited abrasive layer of the electrodeposited grinding tool used in Examples A-1 to A-7 and Comparative Example A-1.

The electrodeposition thickenss t of the electrodeposited abrasive layer 32 in each of the electrodeposited grinding tools of Examples A-1 to A-7 was 0.35 mm. The angle $\alpha$ formed by the central axis of the supporting member 24 and the electrodeposited abrasive layer 32 was 135°, and the outside diameter D of the free end of the electrodeposited abrasive layer 32 was 200 mm. Before forming the cuts 37, the free end portion 36 of the electrodeposited abrasive layer 32 was of a circumferentially continuous wavy form as shown by a two-dot chain line in FIG. 6 (therefore, the dissolved and removed portion of the supporting member 24 was also of a circumferentially continuous wavy form). By forming the cuts 37, the free end portion was rendered in the shape shown by a solid line in FIG. 6. In FIG. 6, $\alpha=60°$, $w=1$ mm, and $d=1$ mm.

Each of the electrodeposited grinding tools of Examples A-1 to A-7 was fixed to the rotating shaft of a grinder and rotated. A silicon wafer (a highly pure silicon semiconductor substrate) was fixed to a worktable of the grinder, and by mo ving the worktable substantially perpendicular to the rotating axis, one surface of the silicon wafer was ground. The ground depth of one surface of the silicon wafer was 15 $\mu$m, and cooling water was injected against the grinding zone.

Figure 7:
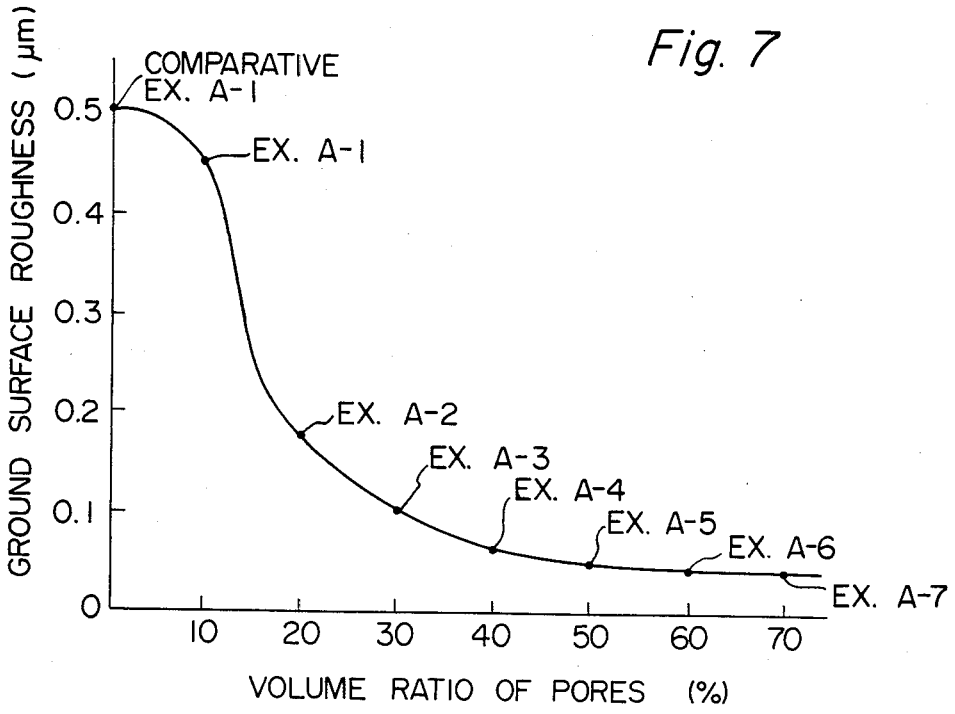
FIG. 7 is a diagram showing the relation between the volume ratio of pores in the electrodeposited abrasive layer and the roughness of a ground surface.

The roughness of the ground surface of the silicon wafer was measured, and shown in the diagram of FIG. 7.

Figure 8:
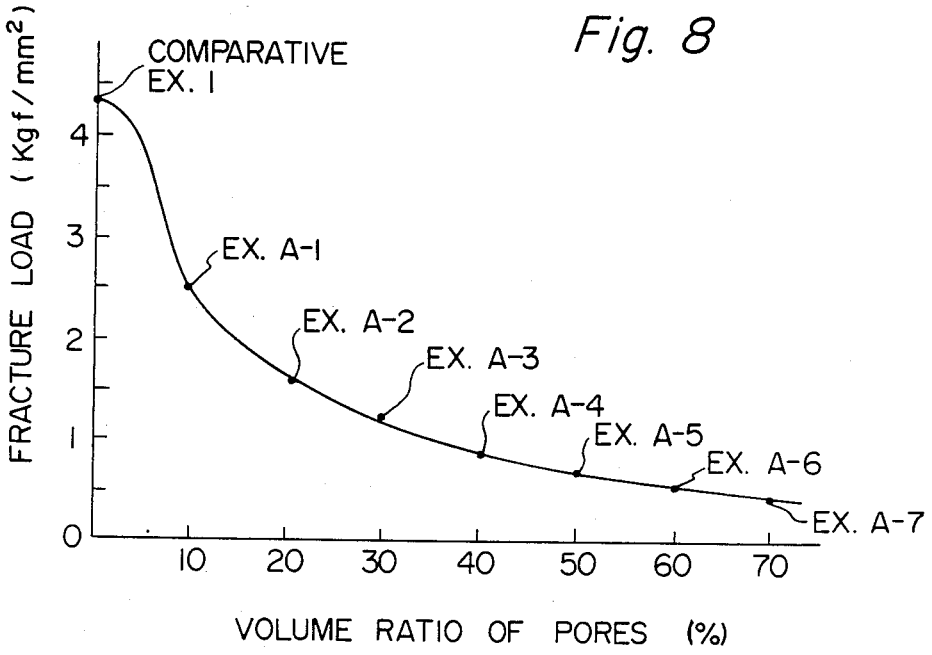
FIG. 8 is a diagram showing the relation between the volume ratio of pores and a fracture load in and on the electrodeposited abrasive layer.

With respect to each of the electrodeposited grinding tools of Examples A-1 to A-7, the load exerted on the electrodeposited abrasive layer was gradually increased, and the load at which the electrodeposited abrasive layer fractured was measured. The results are shown in the diagram of FIG. 8.

Comparative Example A-1

For comparison, synthetic diamond abrasive grains were directly included in an electrolytic solution without coating them with nickel, and electrodeposition was carried out in the same way as in Examples A-1 to A-7. Thus, an electrodeposited grinding tool having an electrodeposited abrasive layer 32 having a pore volume ratio of substantially zero was obtained.

Using the resulting electrodeposited grinding tool of Comparative Example A-1, one surface of a silicon wafer was ground and the roughness of the ground surface of the silicon wafer was measured, in the same way as in Examples A-1 to A-7. The results are shown in the diagram of FIG. 7.

The fracture load of the electrodeposited abrasive layer 32 of the resulting grinding tool of Comparative Example A-1 was measured in the same way as in Examples A-1 to A-7. The result is shown in the diagram of FIG. 8.

It is seen from FIG. 7 showing the accuracy of grinding one surface of the silicon wafer by the electrodeposited grinding tool in each of Examples A-1 to A-7 and Comparative Example A-1 that as the volume ratio of the pores in the electrodeposited abrasive layer 32 increases, the grinding accuracy is increased, and when the volume ratio of the pores in the electrodeposited abrasive layer 32 exceeds 10%, particularly 20%, the grinding accuracy increases markedly.

It is also seen from FIG. 8 showing the fracture load of the electrodeposited abrasive layer 32 in the electrodeposited grinding tool in each of Examples A-1 to A-7 and Comparative Example A-1 that as the volume ratio of the pores in the electrodeposited abrasive layer 32 increases, the fracture load on the layer 32 decreases accordingly, and when the volume ratio of the pores in the layer 32 exceeds 60%, especially 70%, the fracture load on the layer 32 becomes considerably low.

Example B-1

Figure 9:
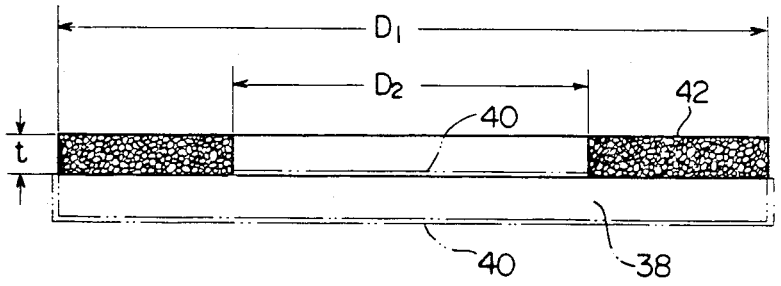
FIG. 9 is a sectional view showing the form of the electrodeposited grinding tool used in Example B-1 and Comparative Example B-1.

Synthetic diamond abrasive grains having U.S. mesh No. 4000 were coated with nickel by an electroless plating method. Then, as shown by the two-dot chain line in FIG. 9, a stainless steel disc 40 covered with an insulating material at the entire side and lower surfaces and the central area of its upper surface was used as a supporting member, and by performing electrodeposition in an electrolytic solution containing a nickel ion in accordance with the method described above with reference to FIG. 3, an annular electrodeposited abrasive layer 42 was formed on the stainless steel disc 40. The stainless steel disc 40 and the electrodeposited abrasive layer 42 formed on its upper surface were withdrawn from the electrolytic solution. The electrodeposited abrasive layer 42 was peeled off from the stainless steel disc 40. The inner and outer circumferential surfaces of the electrodeposited abrasive layer 42 were polished to produce an electrodeposited grinding tool of Example B-1 composed only of the annular electrodeposited abrasive layer 42 as shown in FIG. 9. The outside diameter $D_1$ of the electrodeposited grinding tool was 52 mm; its inside diameter $D_2$ was 40 mm; its electrodeposition thickness t was 0.2 mm; and the volume ratio of pores in the layer 42 was about 40%.

The electrodeposited grinding tool of Example B-1 was fixed to the rotating shaft of a cutter and rotated. A monocrystalline ferrite plate was fixed to the worktable of the cutter, and by moving the worktable, the surface of the monocrystalline ferrite plate was grooved. The moving speed of the worktable, i.e. the grooving speed, was 10 mm/sec, and the groove depth was 500 μm. when the grooves formed on the monocrystalline ferrite plate was examined by a microscope, chipping was less than 2 μm.

Comparative Example B-1

For comparison, an electrodeposited grinding tool of Comparative Example B-1 was produced in the same way as in Example B-1 except that synthetic diamond abrasive grains were directly put in an electrolytic solution without nickel coating and the electrodeposition was carried out to form an electrodeposited abrasive layer 42 having a pore volume ratio of substantially zero.

Using this grinding tool, the surface of a monocrystalline ferrite plate was grooved in the same way as in Example B-1 except that the moving speed of the worktable was changed to 3 mm/sec. Microscopic examination showed that chipping of about 20 μm ocurred in the grooves formed in the ferrite plate.

From the grooving experiments on the surface of the monocrystalline ferrite plate by the electrodeposited grinding tools of Example B-1 and Comparative Example B-1, it is seen that the electrodeposited grinding tool in accordance with this invention in which pores are dispersed in the specified volume ratio in the electrodeposited abrasive layer 42 can perform cutting at high speeds with a high cutting efficiency while reducing shipping and thus increasing the cutting accuracy.

Example C-1

An electrodeposited grinding tool of Example C-1 was produced substantially in the same way as in Examples A-1 to A-7 except that in the electrodeposition step, nickel-coated synthetic diamond abrasive grains and non-coated synthetic diamond abrasive grains were mixed in a volume ration of 2:1, and the mixture was suspended in the electrolytic solution with stirring. The volume ratio of the pores in the electrodeposited abrasive layer 32 was about 40%.

One surface of a silicon wafer was ground in the same way as in Examples A-1 to A-7 using the electrodeposited grinding tool of Example C-1. The roughness of the ground surface of the silicon wafer was 0.07 μm.

The fracture load of the electrodeposited abrasive layer 32, measured in the same way as in Examples A-1 to A-7, was 0.9 kgf/mm$^2$.

Example D-1

An electrodeposited grinding tool of Example D-1 was produced substantially in the same way as in Example B-1 except that in the electrodeposition step, nickel-coated synthetic diamond abrasive grains and non-coated synthetic diamond abrasive grains were mixed in a volume ratio of 2:1, and the mixture was suspended in the electrolytic solution with stirring. The volume ratio of pores in the electrodeposited layer 42 of the resulting electrodeposited grinding tool was about 40%.

By using the electrodeposited grinding tool of Example D-1, the surface of a monocrystalline ferrite plate was grooved substantially in the same way as in Example B-1. Microscopic examination showed that chipping in the grooves formed in the monocrystalline ferrite plate was less than 2 μm.

Example E-1

An electrodeposited grinding tool of Example E-1 was produced substantially in the same way as in Examples A-1 to A-7 except that in the electrodeposition step, non-coated synthetic diamond abrasive grains and copper particles having U.S. mesh No. 2000 were mixed in a volume ratio of 3:1, and the mixture was suspended in the electrolytic solution with stirring. The volume ratio of pores in the electrodeposited abrasive layer 32 of the resulting electrodeposited grinding tool was about 40%.

By using the electrodeposited grinding tool of Example E-1, one surface of a silicon wafer was ground in the same way as in Examples A-1 to A-7. The roughness of the ground surface of the silicon wafer was 0.1 μm.

The fracture load on the electrodeposited abrasive layer 32 of the electrodeposited grinding tool of Example E-1, measured in the same way as in Examples A-1 to A-7, was 1.1 kgf/mm$^2$.

Example F-1

An electrodeposited grinding tool of Example F-1 was produced substantially in the same way as in Example B-1 except that in the electrodeposition step, non-coated synthetic diamond abrasive grains and copper particles having U.S. mesh No. 2000 were mixed in a volume ratio of 3:1, and the mixture was suspended in the electrolytic solution with stirring. The volume ratio of pores in the electrodeposited abrasive layer 42 of the resulting electrodeposited grinding tool was about 40%.

By using the electrodeposited grinding tool of Example F-1, the surface of a monocrystalline ferrite plate was grooved substantially in the same way as in Example B-1. Microscopic examination showed that the chipping in the grooves formed in the ferrite plate was less than 2 μm.

What is claimed is:

1. An electrodeposited grinding tool having an abrasive layer formed by electrodepositing abrasive grains to an electrodeposition thickness at least three times as large as the diameter of the abrasive grains, said abrasive layer having pores dispersed therein in a volume ratio of 10 to 70%.

2. The electrodeposited grinding tool of claim 1 wherein the volume ratio of the pores is 20 to 60%.

3. The electrodeposited grinding tool of claim 1 wherein the abrasive grains are superabrasive grains.

4. The electrodeposited grinding tool of claim 3 wherein the abrasive grains are natural or synthetic diamond abrasive grains.

5. The electrodeposited grinding tool of claim 3 wherein the abrasive grains are cubic boron nitride abrasive grains.

6. The electrodeposited grinding tool according to claim 1 wherein at least a part of the electrodeposited abrasive grains are coated with a metal film prior to electrodeposition.

7. The electrodeposited grinding tool of claim 6 wherein substantially all of the electrodeposited abrasive grains are coated with a metal film prior to electrodeposition.

8. The electrodeposited grinding tool of claim 6 wherein the electrodeposited abrasive grains consist of those coated with a metal film prior to electrodeposition and those not coated.

9. The electrodeposited grinding tool of claim 1 wherein the electrodeposited abrasive layer contains electrodeposited metal particles together with the abrasive grains.

10. A method of making an electrodeposited grinding tool having an abrasive layer comprising providing a medium for suspending abrasive grains, providing abrasive grains having been coated with a metal film, suspending said grains in said medium, depositing said grains by electrodeposition onto a surface of a supporting member to form a layer which is at least three times as large as the diameter of the abrasive grains, the grains by deposition forming an abrasive layer having pores dispersed therein in a volume ratio of 10 to 70%.

11. The method according to claim 10, wherein the abrasive grains are superabrasive grains.

12. The method according to claim 10, wherein the abrasive grains are natural or synthetic diamond abrasive grains.

13. The method according to claim 10, wherein the abrasive grains are cubic boron nitride abrasive grains.

14. The method according to claim 10, wherein the electrodeposited abrasive grains further comprise grains coated with a metal film prior to electrodeposition and grains not coated with metal.

15. The method according to claim 10, wherein the electrodeposited abrasive layer contains electrodeposited metal particles together with the abrasive grains.

16. The method of claim 10, further comprising wherein the grains are previously coated with a metal selected from the group consisting of nickel, copper and titanium.

17. The method of claim 16, further comprising the metal coating on said grains having been done by electroless plating.

18. The method of claim 16, further comprising the metal coating on said grains having done by vapor deposition.

19. The method of claim 16, further comprising the metal coating on said grains having been done by sputtering.

20. The method of claim 16, further comprising the metal coating on said grains having been done by chemical vapor deposition.

21. A method of making an electrodeposited grinding tool having an abrasive layer according to claim 10, further comprising providing an electrolytic solution in an electrodeposition zone, suspending abrasive grains and metal ions in said electrolytic zone, said abrasive grains comprising grains coated with a metal film, providing a supporting substrate a portion of which is covered with an insulating material disposed in said electrolytic zone, said surface substrate also having a peripheral surface area disposed in said electrolytic zone, providing an metal anode immersed in said electrolytic zone and a source of power supply, agitating the electrolytic solution to suspend the abrasive particles, applying a voltage across the anode and the supporting substrate, causing the metal ion which is suspended in the electrolyic zone to deposit on said peripheral surface of the supporting substrate, permitting the abrasive grains to gradually descend and deposit on the upper peripheral edge portion of the supporting substrate, the abrasive grains bonding to the metal deposited on said peripheral surface of the supporting substrate, successively bonding abrasive grains onto the peripheral surface of the supporting member to form an electrodeposited abrasive grain layer, said abrasion grain layer having pores disposed therein in a volume ratio of 10 to 70%.

22. The method according to claim 21, further comprising performing a second electrodeposition step while passing an electrolytic solution not containing the abrasive grains through the electrodeposited abrasive layer.

23. The method according to claim 21, which comprises performing a further electrodeposition while passing an electrolysis plating solution containing a metal ion through the electrodeposited abrasive layer to thereby deposit metal in the spaces in the electrodeposited abrasive layer.

24. The method according to claim 21, which additionally comprises removing the substrate from the electrolytic zone and removing the insulating layer from the supporting material, and polishing the surface of the electrodeposited abrasive layer to the desired shape.

* * * * *